US005957051A

United States Patent [19]

Atwater

[11] Patent Number: 5,957,051

[45] **Date of Patent: *Sep. 28, 1999**

[54] SINGLE WIDTH PRESS WITH DIGITAL INK INJECTION

[76] Inventor: Richard G. Atwater, 112 Smith Ave., Rockford, Ill. 61107

[ * ] Notice: This patent issued on a continued prosecution application filed under 37 CFR 1.53(d), and is subject to the twenty year patent term provisions of 35 U.S.C. 154(a)(2).

[21] Appl. No.: 08/885,299

[22] Filed: Jun. 30, 1997

[51] Int. Cl.[6] ..... B41F 31/04; B41F 31/08

[52] U.S. Cl. ..... 101/366; 101/483

[58] Field of Search ..... 101/366, 365, 101/350.1, 349.1, 363, 484, 483; 118/259, 258, 24

[56] References Cited

U.S. PATENT DOCUMENTS

| | | | |
|---|---|---|---|
| 2,613,600 | 10/1952 | McWhorter | 101/350.1 |
| 4,495,582 | 1/1985 | Dessert et al. | 364/469 |
| 5,315,930 | 5/1994 | Niemiro | 101/366 |
| 5,327,833 | 7/1994 | Danielson | 101/484 |
| 5,575,208 | 11/1996 | Kirihara | 101/366 |

*Primary Examiner*—J. Reed Fisher
*Attorney, Agent, or Firm*—James T. FitzGibbon; Vedder, Price, Kaufman & Kammholz

[57] ABSTRACT

An apparatus for inking the fountain roller of a press. A main body has a longitudinal extent substantially equal to that of the fountain roller, a blade holder disposed beneath and attached to the main body. The main body and blade holder combine to provide several ink channels of narrow width, with the channels terminating in spreader portions. There is a blade in the blade holder which extends to a position adjacent but not touching the fountain roller.

13 Claims, 2 Drawing Sheets

SINGLE WIDTH PRESS WITH DIGITAL INK INJECTION

BACKGROUND OF THE INVENTION

The present invention relates generally to digitally controlled ink pumps and in particular, to the use of digitally controlled ink pumps in what is known as a one-up arrangement of such pumps in an array which includes multiple, series rollers for applying ink to sheets of paper.

According to the invention, there are provided a plurality of ink pumps (or one page pack) for each of the colors to be printed according to the new technique. The page pack may be one pack, in the case of black ink only, or plural packs, in the case of color(s), with one pack for each color being run on the press.

With prior systems, using the force of a cam or screw, plural zones of adjustment in an inking blade were made, resulting from deflection of the blade within its zone of adjustment. Consequently, a system working by operating plural screws for each blade served to vary the distance between the roller and the blade. This required adjustment zones, which were affected to a certain extent by the neighboring zone of adjustment. In such an arrangement, zero ink flow from the reservoir to the roller could not be accomplished. Leakages of ink onto the roller always occurred, and especially at high speeds, blade and roller wear occurred during operation.

The adjustments made by prior art systems are also inherently speed sensitive. They do not always track the press speed correctly. The metering of ink by blade deflection uses the viscosity of the ink in the area between the ink and blade and roller to achieve a specific ink flow rate. As the press speed increases, the ink volume decreases in proportion to the flow. The flow is increased somewhat as more ink is pulled from the portal through the roller, but not sufficient to make up for the difference. As a consequence, ink settings must be made heavy during the startup phase, with the anticipation that under higher speeds, they will diminish correspondingly.

In many cases, the sites that have such zones will not hold adjustment at speed. These mechanisms may be worn, sticky or broken. It is desired to have a zone whose operation is scaled to the press speed. The existing adjustment of press mechanisms often requires a fineness of adjustment that is difficult to achieve. It is unrealistic to expect accuracy, when the slightest touch sends the control into a varied ink delivery.

Furthermore, in the prior art, ink must be carried to the fountain and poured or ladled in. The ink is in a trough, where it remains open to the air. Settling of contaminants is messy, requiring constant monitoring. Operators have to ladle in ink as the supply dwindles. If they miss a fountain with ink, or one is not filled at the proper time, additional waste results.

Color changes with existing presses require considerable time. It is necessary to remove the entire trough and clean it up. Ink disposal costs more and more money as environmental concerns mount. Initial adjustment takes an unreasonably long amount of time. Press preset, plating and ink/water setting take too long, and require the waste of too much paper using the cam or screw type adjusters. Skilled labor is required to adjust the old fashioned cam and screw type adjusters.

With individual, and preferably digital or volume ink control, it is possible to arrive at the correct setting within a short time, keeping customers that would be lost to other shops. With the arrangement of color towers, personnel have to climb stairways and ladders to achieve ink adjustment and ink control. The inventive digital ink system will create a revolution in the publishing trade.

The ability to carry the ink flow from zero to as much as is required and to have the ink flow proportioned to the line shaft, with a speed sensor, is a unique feature of the present invention. In a standard open fountain configuration, a metering blade is placed close to the ink drum and used to control ink flow from the reservoir. The blade scrapes an ink film of a given thickness, which varies throughout the length of the blade. Thus, the blade is placed in a different configuration as determined by the adjustment throughout its length. This is done by adjusting the blade gap between areas of different ink flow. As the press speed goes up, the ink delivery will vary accordingly.

In a digital injector system, the ink is not metered with a gap. Rather, it is pumped by a microprocessor controlled positive displacement injector in exact quantities. The transfer blade is not used to control flow, but only to spread the ink evenly across the control zone. Thus, the transfer blade is adjusted to a single constant distance from the roller and this distance is never changed.

As press speed varies, the pumps all adjust automatically to overcome the new ink flow requirement based on a column-to-column position for every part of the press. Press speed information is broadcast to each page pack, allowing this projection to be performed thousands of times every second. The result is unmatched precision and repeatability. In addition, the unit will track the requirement set out for that particular pump. Under conditions where no ink is required to be supplied to a particular zone, the transfer blade is still maintained at its contact distance from the roller, but the roller goes empty, because the pump supplies no ink to that zone.

The ink need not remain open to the air. It is delivered from the tank directly to the page pack inlet via permanently plumbed ink supply lines. There, it is dispersed to the individual chambers and pressurized by the individual injectors. It is sent out through the plastic tubing into the delivery head in precisely controlled quantities at exactly calculated flow rates. The ink train rollers move the ink away in exactly the same fashion as they did previously. The result is a smooth and even ink supply that tracks press speed changes so well it is truly a "set and forget" operation. In many cases, the operator can accurately present a print position by visually sizing the plate and pre-adjusting the ink settings.

In view of the failure of the prior art to provide a volume-controlled and preferably digital ink system for one or more presses, it is an object of the present invention to provide such a system.

Another object of the invention is to do away with individual adjustments for each part of the blade accompanying prior art systems.

A further object of the invention is to provide a system which is capable of varying the amount of ink delivered both in response to individual settings on an ink pump, and also to cause the amount of ink fed to be proportional to press speed.

Yet another object of the present invention is to provide a system wherein microprocessor based, computer driven accuracy and solid reliability can be attained job after job.

Still another object of the present invention is to provide a system wherein one or more columns have no ink whatsoever.

It is a further object of the invention to have permanently plumbed ink supplies which in turn can maintain the viscosity and keep the ink contaminant-free during operation.

Another object of the invention is to do away with open-to-the-air ink vats, which are also open to contamination.

A further object of the invention is to produce a press that is capable of responding to a change in the ink amounts delivered, without overshoot, undershoot or oscillating ink densities.

A still further object of the invention is to provide a system which will work with both heat set or cold set inks.

An additional object of the invention is to provide a replacement system of ink control which, is applicable to tower units of all kinds, including towers having several colors.

It is an object of the present invention to allow press personnel to be put to more profitable uses, inasmuch as "cross-training" becomes easier where ink adjustment is not an art known only to the journeyman.

Another object of the invention is to provide the ability to visually gauge and preset the press before the first cylinder turns.

Yet another object of the invention is to reduce waste and to provide more output for both the ink and the paper used in total.

A further object of the invention is doing away with the need to provide for electrical or mechanical adjustments once the system is set.

Another object of the invention, in some embodiments, is to provide a system which includes high speed, noise immune fiber optic communications.

Still another object of the invention is to provide a system which will track the consumption of inks used in various press runs.

Another object of the invention is to control the application of the ink volumetrically, as opposed to attempting to control the ink film thickness by a movable blade or the like.

A still further object of the invention is to control ink thickness by a volumetric control and thus avoid allowing water to dilute the thickness of the ink and vary the amount of actual ink used at a given setting of the press.

Another object of the invention is to provide an array of conversion parts which enables one to convert an existing press to a volume-based ink delivery system.

Another object of the invention would be to provide a system of digital ink pumps and their associated mechanism for supplying ink, and having the apparatus available as a kit to install on existing presses, without change to the remaining parts of the press.

Yet another object of the invention is to provide a method of replacing the ink baths with a digital volume-controlled inking system.

Still another object of the invention is to provide a new means of supplying ink to an older press, said method involving replacing the ink and feed mechanism, including their associated keyboard(s) and plural individual outlets for said each of the pumps, without change to the remainder of the press.

The foregoing and other objects of the invention are achieved in practice by providing a system which includes a page pack for use in a press, or one in a series of pages for each color, wherein the page pack includes plural ink pumps of the digital variety, and wherein there is a novel arrangement of ink feeding units, each fanning out and adapted to supply ink to a particular column of the paper being printed.

The manner in which the foregoing and other objects and advantages are achieved in practice will become more clearly apparent when reference is made to the following detailed description of the preferred embodiments of the invention set forth by way of example and shown in the accompanying drawings wherein like reference numbers indicate corresponding parts throughout.

BRIEF DESCRIPTIONS OF THE DRAWINGS

FIG. 1 is a side elevational view, partly diagrammatic in character, and showing a control board, one of the pumps of a digital injector type, a pivot frame and ink injector lines of the present invention, and showing a fountain roller, a micrometric roller, and a transfer roller of the invention;

FIG. 2 is a greatly enlarged vertical sectional view of one injector of the invention, and showing the distribution head, the blade, the blade support, and the fountain swing frame and their relationship to the fountain roller positioned next to the distribution head; and FIG. 3 is a view, taken along lines 3—3 of FIG. 2 and showing several of the ink patterns made by the ink distributors of the invention.

DESCRIPTION OF THE PREFERRED EMBODIMENTS OF THE INVENTION

Figure 1:
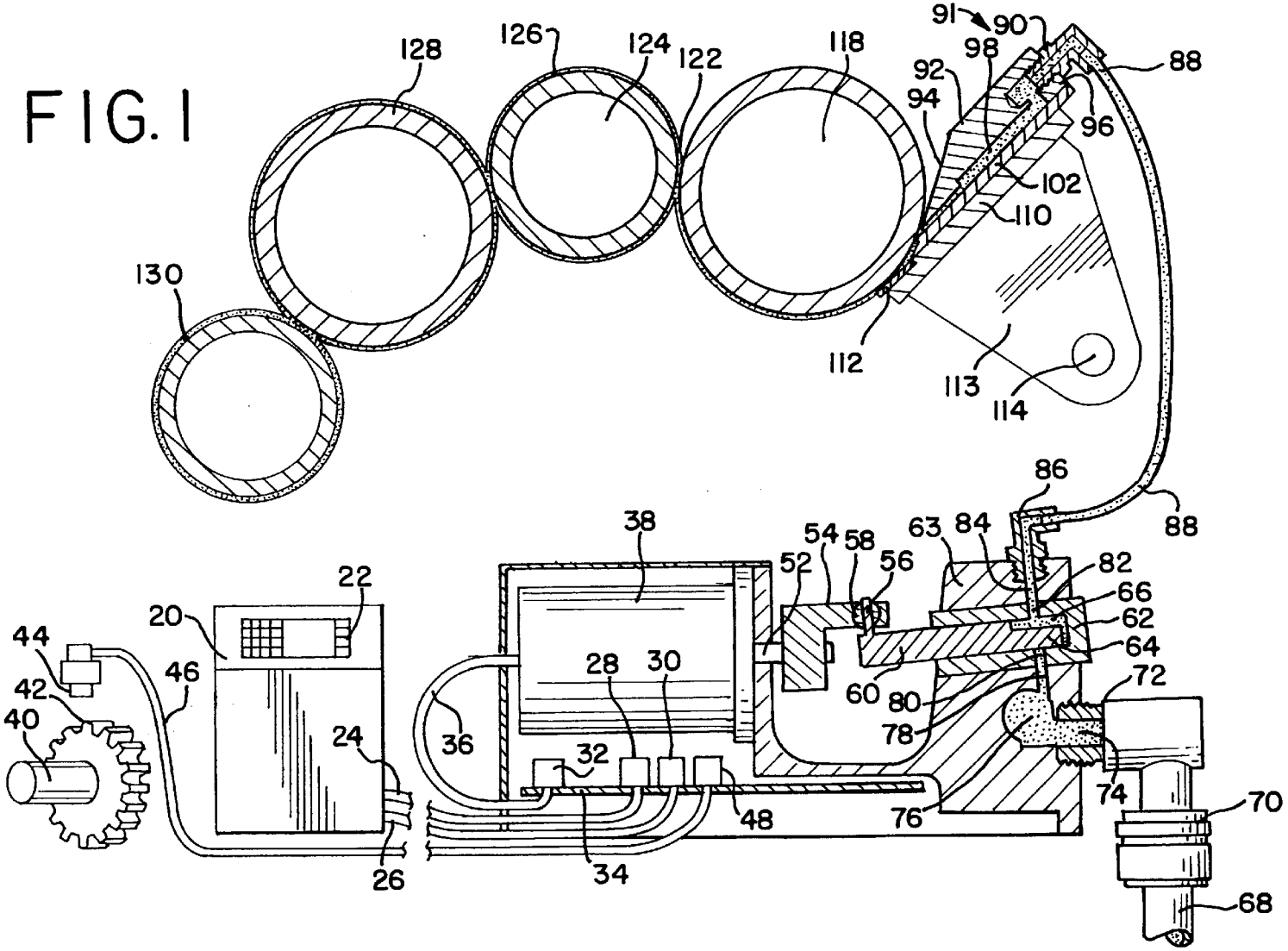

While the invention will be seen to be embodied in a number of applications, a description will be given wherein the unit involves several main groups. These include a keyboard or control unit, a digital ink pump assembly, and a swing frame and plural injector pumps for inking the first of several rollers placed in a series relationship. The invention also includes a transfer blade and several stages of "fanning out" the ink supplied by the digital ink pumps.

Referring now to the drawings in greater detail, there is shown (greatly reduced for clarity), a keyboard 20 having a plurality of keys 22 thereon and capable of sending instructions from the keys through the lines 24, 26. The keyboard includes keys for instructing the unit how much ink to flow, either collectively or individually. The collective unit includes a single key for increasing all flow, while the individual keys permit one pump to handle more ink, while another pump less.

The instructions sent by the keys are forwarded along the lines 24, 26 to keyboard elements 28, 30. Here, the messages are forwarded from the individual elements 28, 30 to a plurality of output drivers 32 contained on a circuit board 34. Each driver is connected, as by a line 36, to the armature of an individual ink pump 38. It is understood that there are usually eight such ink pumps in each array of digital pumps, one only being illustrated and described for purposes of clarity.

In addition to the control achieved by the individual pumps, cumulative control is achieved by a line shaft 40 which contains a toothed wheel 42. As the line shaft rotates, (at whatever speed) this wheel 42 sends a digital signal picked up by the detector 44 and sent along the lines 46 to drive element 48. The clocking pulse therefore comes from the line shaft, and the individual pulses came from the individual pumps. In this way, the ink is delivered to the system. The keyboard thus controls the output of each pump relative to another, and the line shaft 40 and its associated gears 42, 44 controls the speed at which the ink pumps are ultimately operated.

The armature 38 of the drive motor, when actuated, turns a rotary shaft 52. The crank pin 54 is driven at a speed which is equal to the speed of the shaft. A carrier bearing 56 is adapted to receive a drive pin 58 from the piston pump 60. The piston pump 60 rotates, and because of its inclination and because its drive link portion is offset from the axis of the piston, as the piston moves in and out, relative to its housing 62, it pumps fluid therefrom.

By way of further explanation, a plurality of individual pumps 60 are arrayed together within a single housing 62, and a drive motor 38 is provided for each of the pumps. In a further preferred form, the motors for the pumps are so-called stepping motors. In the arrangement shown, a digital control circuit provides precisely timed output pulses, and each output pulse results in a very small step of the motor, which typically requires 200 to 400 steps per revolution.

The digital pulse train thus controls the power supplied to the motors and provides communications or instructions, while the line shaft component, which advises the microcomputers of the press speed, regulates the speed and hence the overall output rate of all the pumps.

The piston 60 includes a solid portion 64 and a cutaway relief portion 66. As the pump rotates, the rotation and reciprocation of the piston causes ink flow in the system, as follows. The ink is drawn up from a master supply 68 through a fitting 70 and thence to the through opening 72 leading into a longitudinal gallery 74 which extends the length of the block containing the cylinders.

The main ink flow for each piston 60 is through an individual inlet for each piston 60, with the ink 78 being drawn into the inlet area 80 of the pump as the piston 60 is withdrawn. Shortly thereafter, the outlet port 82 comes into registry with the relieved portion 66, causing the ink 84 to flow from there through a fitting 86 and out the outlet 88. A further description of the ink flow in this type of pump is available in U.S. Pat. Nos. 3,168,872, 4,008,003, 4,941,809 and others issued to Pinkerton, or Pinkerton et al. The circuit board of a type described in U.S. Pat. No. 5,472,324, issued Dec. 5, 1996.

Figure 3:
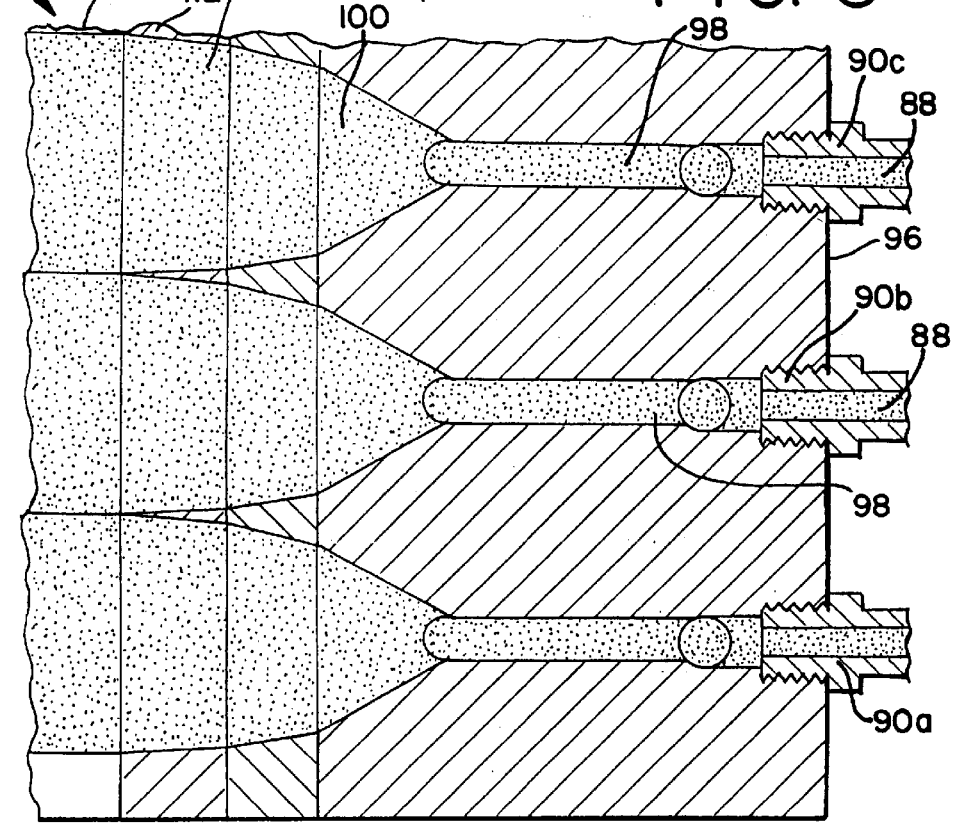

From here, the ink proceeds into a fitting 90, and there the ink passes to the distribution head 91, which will now be described. The distribution head comprises a main body portion 92 in which the fitting 90 is received. The-exterior of the distribution head includes an exterior surface 94 with a slight slope to it. The rear surface 96 is flat (FIG. 3). The bottom includes a main portion 98 for ink, most of which is of a relatively small width, while the balance of the ink channel terminates in a spreader or fan-out position 100. The remainder is flat, as at 97, so as to mate with the blade holder 102. Hence, ink that is trapped in this area must be spread or fan out and assume the position of FIG. 3.

Immediately beneath the body portion 92 containing the ink is a blade holder unit 102. This unit has an upper, flat portion 104, a lower flat portion 106, and a front portion 108 that is tapered to approximately the same extent as its counterpart 94. A blade support 110 lies beneath the blade holder 102, and contains a notch, of greater or less length, for holding a blade 112. The blade support 110 is formed separately from, or as a part of the swing frame 112, which pivots about point 114.

For each of the digital ink pumps delivering a charge of ink, (mostly in varying quantities), the first roller in the sequence, i.e., the fountain roller 118 contacts and picks up a supply of ink. This unit 118 is spaced from the blade and the blade support by a working distance or clearance 120. The next roller is spaced by a working clearance 122 that lies between a micrometric roller 124 and the fountain roller 118. This micrometric roller 124, which may contain a knurled surface 126, operates at web speed, whereas the roller 118 operates at a lower speed. The web speed or transfer roller 128 is normally made from a rubber material, and this transfer roller 128 operates also at web speed. Attached to the transfer roller is the oscillating roller 130, which is normally all the rollers in a sequence. Other rollers may be provided, or course.

Figure 2:
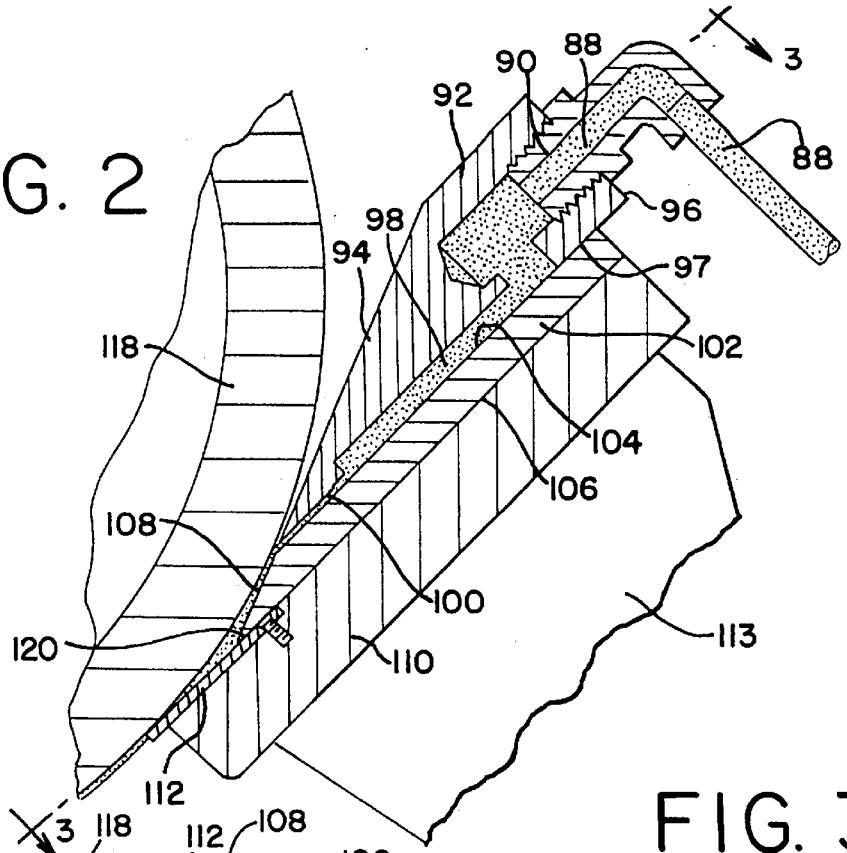

By referring to FIGS. 2 and 3, the operation can be more clearly viewed. Here, the ink is shown to be spread from its region of concentration 90, 90*a*, etc. to an area in which it is dispersed, finally reaching a tangent point to that of an adjacent discharge. At this point, (or at any point, for that matter) the blade does not move, but only serves to spread or transfer the ink evenly, to the extent this has not been done already.

One basic feature of the invention is that with the digital pumps set to self-adjust to the new ink flow requirement on a column-by-column basis, this occurs constantly as press speed varies. Press speed information is "broadcast" to each page pack, allowing this adjustment to be performed thousands of times each second providing unparallel accuracy. In a condition where little or no ink is required, the blade is still maintained at a constant distance from the roller, but the pump supplies no ink and consequently, the zone is empty.

There is no need to make adjustments, either mechanical or electrical, once the system is initially set. There is no physical or mechanical connection between the press and the digital ink supply system. Any gears, line shafts or screws do not form a part of this connection. A few simple plastic hoses and a single narrow, lower power, low voltage cable takes the place of all units.

The page packs may be purged of the color very rapidly. Inasmuch as there is no existing bath of ink, the swing frame is merely taken back into its non-operating position and the ink is rapidly purged by running through the pumping cycle a number of times. Thus, a high speed purge may be made of all of the ink pumps, without having to disconnect anything from the press. This provides much faster color changes. The open fountains, which may be present, are no longer in use with the new system. Therefore, there are no ink vats to be contaminated.

An accuracy of up to 1/10 to 1% is able to be achieved, due in part to the extreme speed and power of the internal page pack components. Mechanically driven units lack this capability. The instant response to edits placed by manipulating the keyboard are made instantly. There is no overshoot or undershoot, nor oscillating ink densities in adjusting to the new flow rate. This is an important advantage of the invention. The concept of having the digital conversion is that, once the ink density is set, it remains at the ideal density, regardless of press speed.

Although only one unit has been described, in a tower unit, the operators need not scale ladders during the press run. At all times, after the press is set, there is no need to climb to change any of the colors on the tower. The density, and all adjustments, may be made from the keyboard or console.

A result of the foregoing is that control of ink put on the paper is achieved volumetrically. The prior art attempted to control the ink applied by using a blade with the rollers in greater or less contact therewith. In fact, this was an attempt to control application rate by film thickness. This system is by and large, unsuccessful, for a number of reasons. The ink-water ratio are constantly changing, with water being picked up in the ink, this cannot be remedied. The present invention adds a certain, fixed amount of ink with each revolution of the roller, and no water is fed back. If so, the water is of no concern, because it is simply neglected in the process of adding ink.

A particular advantage of the present invention is that the unit may be retrofitted to existing presses without any complexities. For example, for a press which is equipped with an ink bath or similar type arrangement, it is necessary only to return the swing frame 112, which pivots about 114, to its withdrawn position and remove it.

The new apparatus from the swing frame forward is replaced. This includes the blade support 110, the blade 112, and the blade holder 102. Moreover, the unit will include an upper portion 92 with a fan-out or spreader portion and a lower, flat portion. These are equipped with six or eight (or other suitable number) of fittings.

The next unit that is installed is a line shaft 40 (and this unit need not be replaced as a whole), its gear tooth 42 (or other sending arrangement) and its sending unit 44. In addition, the keyboard and the digital pump array will be replaced.

There will be one of these page packs for every color of ink used in the press. Thus, in a four, five or six color press, there would be individual replacement of parts, but not of any other components of the press. In other words, everything back of the rollers would be replaced in the depiction of FIG. 1. Of course, the pivot pin and the swing frame portion per se of the press need not be replaced in total, assuming that the portion from the blade support on were replaced.

It is possible to use as an option, a scanner interface with the press. Therefore, presets become totally automatic using this sort of feedback device. The advantage of having a keyboard is that is can be placed next to the unit, or it can be centralized at a console. The option of having both the keyboard and a console offers the ultimate in press ink and water control. While the keyboards control only the ink, the console can handle spray bar dampeners compensators as well as interface with material handling equipment and fax/negative scanner devices.

Regarding options available with the system, it is possible to allow the PCS console to measure ink usage. In fact, this may be done all the way down to the per column level. This makes it possible to track consumables down to the finest degree. The optional press controls can provide features such as a noise immune fiber optic communication at high speed.

The options available also include a dampener control, negative scanner interface and positive scanner interface, as well as handling materials options. These may be used and made available anyplace. The keyboards made according to the present invention are "smart" and will remember their last settings. Accordingly, if there is a power failure, the correct setting will not be affected.

It will thus be seen that the present invention provides pre-existing single width press with digital or volumetric ink injection having a number of advantages and characteristics including those expressly pointed out here, and others which are inherent in the invention. An illustrative embodiment of the product of the invention having been shown and described, it is anticipated that variations to the described form of apparatus will occur to those skilled in the art and that such modifications and changes may be made without departing from the spirit of the invention, or the scope of the appended claims.

We claim:

1. An apparatus for inking the fountain roller of a press, said apparatus comprising a main body having a longitudinal extent substantially equal to that of said fountain roller, a blade holder disposed beneath and attached to said main body, a plurality of ink inlets spaced longitudinally along the length of at least one of said main body and said blade holder, said main body and said blade holder cooperating so as to provide, between them, a plurality of ink channels of narrow width and a given height, said channels terminating downstream in spreader portions of gradually decreasing depth and of increasing width such that their outer margins extend gradually outwardly in both directions from said channels to points closely adjacent each other, said main body and said blade holder both having front surfaces that are substantially parallel to each other and are inclined so as to be approximately tangent to said fountain roller, a blade support element, a blade received non-adjustably within a notch in said blade support element adjacent a tapered end of said blade holder, said blade extending at a slight angle to said inclined front surfaces, said blade, in positions of use, being adjacent but not in contact with said fountain roller, said blade, said blade holder, said blade support and said main body portion being adapted to be swung as a unit to a position adjacent said fountain roller of said press.

2. An apparatus as defined in claim 1, wherein said plurality of ink inlets are formed solely in said main body.

3. An apparatus as defined in claim 1, wherein said plurality of ink inlets are formed solely in said main body and said main body further includes formations defining said ink channels and said spreader portions, said blade holder being substantially flat throughout its upper surface that faces said main body.

4. An apparatus as defined in claim 3, wherein said ink inlets include tapped openings and for each tapped opening, there is a fitting adapted to receive the output of a digital ink pump.

5. An apparatus as defined in claim 1, wherein said plurality of ink inlets is six.

6. An apparatus as defined in claim 1, wherein said plurality of ink inlets is eight.

7. A method of replacing the open fountain system of inking in a one-up press with a novel ink distribution head and swing frame, said method comprising removing the swing frame and the associated open ink bath from adjacent the fountain roller in a one-up press, and substituting therefore an ink distribution head and swing frame, including a main body having a longitudinal extent substantially equal to that of said fountain roller, a blade holder disposed beneath and attached to said main body, a plurality of ink inlets spaced longitudinally along the length of at least one of said main body and said blade holder, said main body and said blade holder cooperating so as to provide, between them, a plurality of ink channels of narrow width and a given height, said channels terminating downstream in spreader portions of gradually decreasing depth and of increasing width such that their outer margins extend gradually outwardly in both directions from said channels to points closely adjacent each other, said main body portion and said blade holder both having front surfaces that are substantially parallel to each other and are inclined so as to be approximately tangent to said fountain roller, a blade support element, a blade received non-adjustably within a notch in said blade support element adjacent a tapered end of said blade holder, and positioning said blade adjacent but not in contact with said fountain roller by moving said swing frame adjacent said fountain roller of said press.

8. A method as defined in claim 7, wherein said plurality of ink inlets are formed solely in said main body and said main body further includes formations defining said ink channels and said spreader portions.

9. A method as defined in claim 8, wherein said ink inlets include tapped openings and fittings received in said tapped fittings, said fittings being connected with individual ink lines from ink pump s operated by digitally controlled stepping motors.

10. A method as defined in claim 7, wherein said plurality of ink inlets is six.

11. A method as defined in claim 7, wherein said plurality of ink inlets is eight.

12. A swing frame and associated distribution head apparatus for use with a one-up printing press, said apparatus comprising, in combination, an elongated swing frame unit having a pivot axis and, spaced therefrom, an elongated blade support, said blade support having, along one edge thereof, an elongated notch to support an elongated blade and an elongated blade unit non-adjustably received in said notch, said distribution head comprising an elongated blade holder including an upper flat portion, a lower flat portion and a tapered front surface connecting said upper front and lower rear portions, an elongated main body disposed atop said blade holder, said main body having a plurality of fittings spaced apart along the length of said body for receiving a plurality of ink flow lines, a plurality of ink inlets in said body terminating in narrow ink channels formed within said body and lying transverse to said elongated extent of said body, a plurality of spreader formations of increasing width and decreasing depth formed in said body, the outer margin of said spreader formations gradually becoming substantially tangent to one another in the area between said main body and said blade holder.

13. A swing frame and distribution head apparatus as defined in claim 12, wherein said plurality of ink inlets is from six inlets to eight inlets.

* * * * *